US007013622B2

(12) United States Patent
Berdelle-Hilge

(10) Patent No.: US 7,013,622 B2
(45) Date of Patent: Mar. 21, 2006

(54) SYSTEM AND METHOD FOR HANDLING AND POLYWRAPPING ARTICLES

(75) Inventor: Peter Berdelle-Hilge, Constance (DE)

(73) Assignee: Siemens AG, Munich (DE)

( * ) Notice: Subject to any disclaimer, the term of this patent is extended or adjusted under 35 U.S.C. 154(b) by 28 days.

(21) Appl. No.: 10/933,354

(22) Filed: Sep. 3, 2004

(65) Prior Publication Data

US 2005/0044817 A1 Mar. 3, 2005

Related U.S. Application Data

(60) Provisional application No. 60/499,612, filed on Sep. 3, 2003.

(51) Int. Cl.
*B53B 9/02* (2006.01)

(52) U.S. Cl. ..... 53/451; 53/453; 53/461; 53/553; 53/542; 53/247

(58) Field of Classification Search ..... 53/247–249, 53/251, 252, 255–260, 450–453, 461, 463, 53/534–537, 542, 553, 559, 562

See application file for complete search history.

(56) References Cited

U.S. PATENT DOCUMENTS

| | | | | | |
|---|---|---|---|---|---|
| 3,927,508 | A | * | 12/1975 | Campbell, III | 53/251 |
| 4,027,460 | A | * | 6/1977 | Orr | 53/535 |
| 4,398,383 | A | * | 8/1983 | Prakken | 53/537 |
| 4,683,708 | A | * | 8/1987 | Linder | 53/540 |
| 4,711,066 | A | * | 12/1987 | Fox et al. | 53/436 |
| 4,712,355 | A | * | 12/1987 | Dorner et al. | 53/443 |
| 4,788,812 | A | * | 12/1988 | Morita et al. | 53/447 |
| 4,817,365 | A | * | 4/1989 | Yawberg et al. | 53/438 |
| 5,117,614 | A | * | 6/1992 | Johnsen | 53/540 |
| 5,495,700 | A | * | 3/1996 | Stauber et al. | 53/118 |

* cited by examiner

*Primary Examiner*—Stephen F. Gerrity
*Assistant Examiner*—Hemant M. Desai
(74) *Attorney, Agent, or Firm*—Siemens AG; Jacob Eisenberg

(57) ABSTRACT

The present invention relates to a system and method for extracting and polywrapping articles stored in a pocket of a container. The container may be part of a DPP machine. In operation, a separator sheet is extracted, the bottom of the pocket opened so as to allow the articles therein to drop into a polywrapping device, and the polywrapping device sequentially polywraps the articles. After the articles are dropped from the pocket, the separator sheet is reinserted. Rollers and cross sealer bars, appropriately placed, facilitate the polywrapping. Optional use of an H-belt is possible as well as a tracked sheet bottom transporting the pockets to the polywrapping device.

17 Claims, 6 Drawing Sheets

SYSTEM AND METHOD FOR HANDLING AND POLYWRAPPING ARTICLES

CROSS REFERENCE TO RELATED APPLICATIONS

The present application claims priority to provisional patent application No. 60/499,612, filed on Sep. 3, 2003, which is herein incorporated by reference.

BACKGROUND OF THE INVENTION

The present invention is directed to the filed of article handling and more particularly to a system and method for extracting and polywrapping sorted articles. The articles are typically sorted by a delivery point packaging machine (DPP). Articles as used throughout the application is defined as at least one of mail, books, magazines and other such articles. DPP machines are used to sort large batches of articles. The articles are fed into the machine by feeders which also decode the destination address of the article as well as the article's thickness. The DPP includes a plurality of slots or pockets for receiving articles. The pockets are logically assigned a destination address and once the address is known (as will be the case when the article is fed into the DPP) the article is routed to its respective pocket. The pockets are stored in containers, themselves stored in a casting of a tower.

Once the batch of articles is appropriately sorted, it may become necessary, depending upon the application, to extract and polywrap the articles. Extracting the articles from the pockets entails the articles removal from the pockets with the sorting order of the articles within the pockets maintained. Polywrapping the articles entails wrapping at least one of the articles in a polywrap—a plastic like material—which facilitates article handling and the like.

Current systems for extracting and polywrapping articles are cumbersome, complicated, bulky and present engineering challenges. Additionally, extracting and polywrapping systems have not been effectively applied to DPP machines. Accordingly, a need exists in the art for effective and cost efficient article extraction and polywrapping. An additional need is that the aforementioned be applicable to DPP machines.

SUMMARY OF THE INVENTION

The present invention is directed to a method for performing article extraction and polywrapping. The invention is further directed to a system for carrying out the method. In the method: the casing are removed to an extraction zone or into an extraction position; a separator sheet present in the container is removed; the bottom of each pocket in the container is individually opened allowing the articles stored therein to fall through the opening; the downward motion of the article is assisted by an H-belt; the articles are received at a polywrapping station where the articles are sequentially polywrapped.

The present system comprises means for accomplishing the aforementioned method steps. In particular, the bottom of the pocket may include a plurality of tracks and the walls defining the pocket may include protrusions which interact with the tracks so as to facilitate lateral displacement of the pocket floor and prevent any articles from becoming caught between a pocket side wall and its base. The article contents remain within the pocket. The H-belt may comprise a top webbing running between the two walls and descendible to the floor. The polywrapping station my include a first and second crimping unit to crimp polywrap film at the beginning and end of the article descent, respectively so as to encase the articles in the film. Likewise, the top of a former set of polywrapped articles may form the bottom of a subsequent set of polywrapped articles, thereby making successive and more efficient use of the film. Additionally, the polywrapping station may include a pair of rollers as well as cutting means arranged to sequentially seal and separate the sets of now polywrapped articles.

BRIEF DESCRIPTION OF THE SEVERAL VIEWS OF THE DRAWINGS

These and other embodiments of the present invention will be set out below in more detail with respect to the specification and claims, wherein like reference numerals refer to like parts. In the figures:

DETAILED DESCRIPTION OF THE INVENTION

Figure 1:
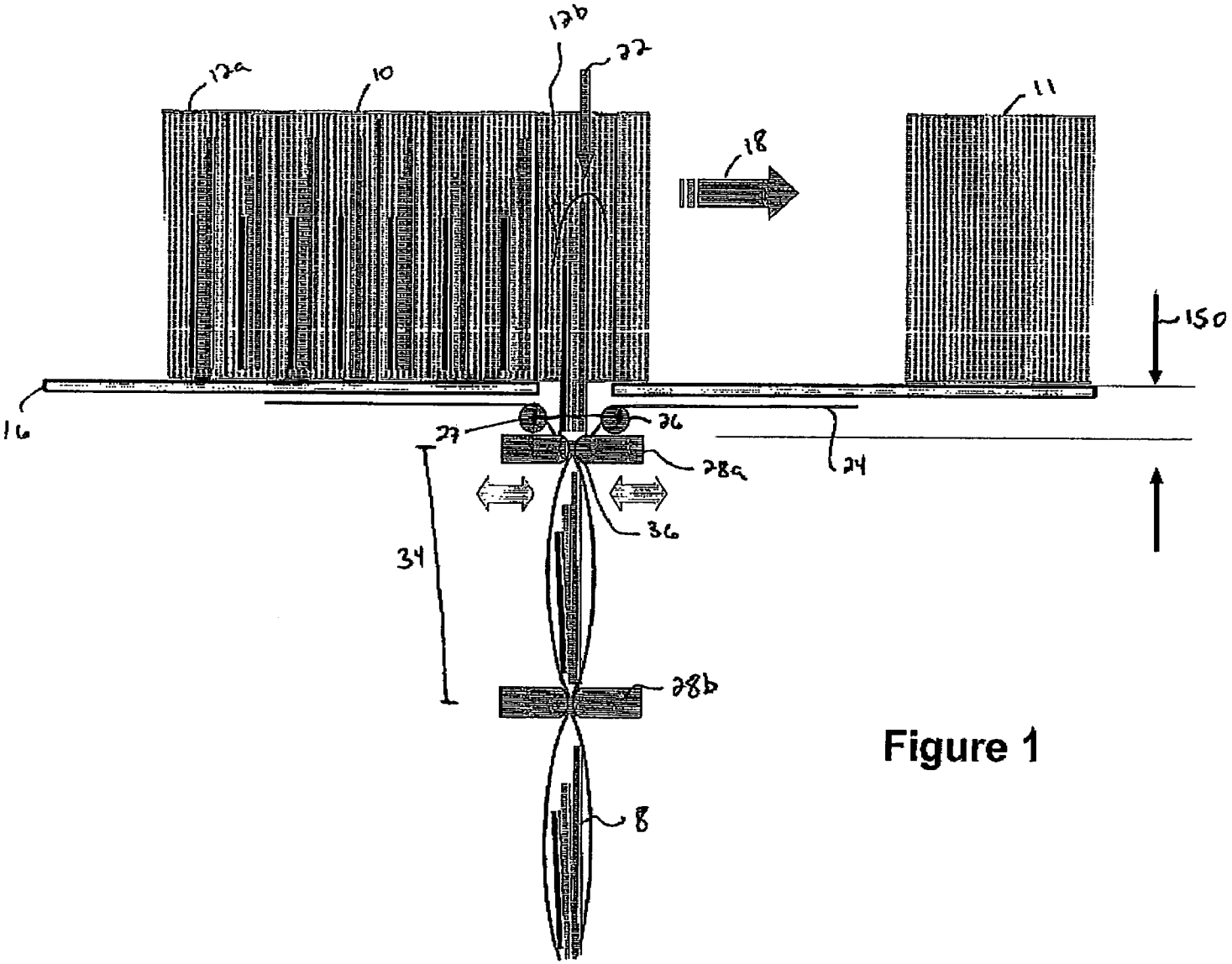
FIG. 1 depicts a schematic of a first embodiment of the present invention.

FIG. 1 depicts a schematic representation of a first embodiment of the present invention. As depicted, a pocket carrier or POD 10 is being indexed in a direction indicated by arrow 18. A second carrier 11 is depicted upstream. The function of the carriers used in the present system are identical and will be described with reference to an example carrier 10.

Carrier 10 comprises a plurality of pockets 12*a* and 12*b* for accommodating at least one article 14 therein. The size and number of pockets per container and the number of articles accommodated therein are a matter of design. Pockets 12*a* include articles therein, while pocket 12*b* is empty. The pockets generally have at least one open side for article insertion. The pocket bottoms may be selectively opened as will be discussed herein. The pocket tops may be open or close as dependent upon design. As depicted in FIG. 1, the container travels 12 along a bottom 16 which includes at least one opening 20. The container may alternatively travel upon rails which by definition include an open bottom. For purposes of illustration, the solid bottom 16 with opening 20 will be referred to hereinafter. The opening 20 is positioned to align with the pocket bottom and is sufficiently large to facilitate passage of articles therethrough.

Positioned below opening 20 is polywrapping means 21 comprising film 24, a pair of rollers 26, and a plurality of cross sealing bars 28*a*, 28*b*. The polywrapping means includes other components known to one skilled in the art and not discussed here for purposes of clarity. The film is introduced into the polywrapping means from two locations so as to run between the rollers and sealing bars in a downward direction away from the sheet bottom 16. Other film introducing schemes may be used as envisioned by the skilled person. As depicted in FIG. 1, the film 24 is positioned below sheet bottom 16 and is laterally and vertically displaceable. The film passes over and between the rollers 26 and descend downward in between the opposing cross sealer bars 28*a*, 28*b*. The rollers 26 are spaced a part a distance 27 sufficiently large so as to allow articles 14 to pass, therebetween. The rollers 26 may be coplanar and/or coaxial. Positioned downstream of rollers 26 (in the direction of film flow) are the cross scaling bars 28*a* and 28*b*. The cross sealing bars are spaced apart a vertical distance 34 which is larger than the longest article (4*a*). Likewise, the cross sealing bars are spaced apart a horizontal distance sufficiently large so as to allow articles within the pocket to pass therethrough. The cross bars may be coplanar and/or coaxial. The cross sealing bars arc laterally displaceable so as to join at point 36. At point 36, the two sides of the film are brought and sealed together. Cross bars 28*a* define an upper position and cross bars 28*b* a lower position, in between which the articles become sealed between two foils of film. As further depicted, a group of articles 8 have descended through opening 20, in the direction indicated by arrow 22. The descent 150 may be about 50 mm, although other descents lengths may be used by design.

Figure 2A:
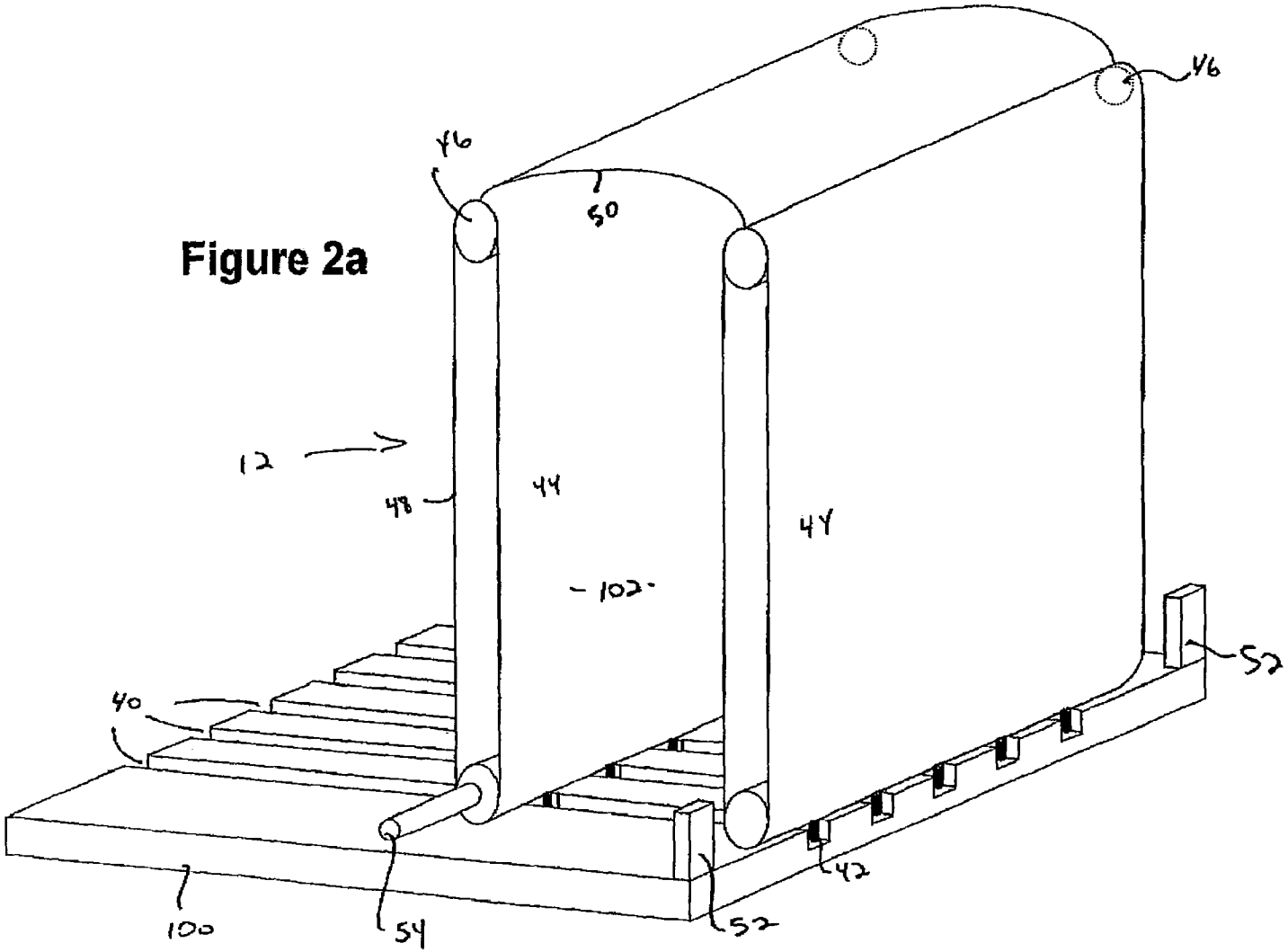
FIG. 2*a* depicts a perspective schematic view of a pocket according to the present invention.

FIG. 2 depicts a single pocket 12 and a POD base 100. Base 100 includes a plurality of tracks 40 through which prongs 42 may pass. The tracks run substantially parallel to indexing direction 18 (FIG. 1). A plurality of prongs 42 are attached to a pocket wall 44 comprising a separator sheet design. This design entails a plurality of spaced rollers 46. The rollers are displaced at four corners defining the pocket. Running vertically about the rollers is a first sheet 48 in an endless loop. Running horizontally between the rollers is a second sheet 50. The combination of the two sheets 48 and 50 as well as the base 100 define a pocket cavity 102. When the rollers are rotatably engaged, the second sheet 50 can be made to descend in the direction of the base 100 as well as rise away. The base 16 further includes a pair of latches 52. Bottom rollers, downstream in the direction of index 18, include a pair of lateral protrusions 54 for abutting the latches 52 thereby temporarily halting the lateral displacement of the pocket 12 with respect to base 100 or visa versa. The protrusions prevent articles from getting caught between pocket side walls and base. The lateral movement is facilitated by the prongs 42 running in track 40. The lateral movement will be approximately equal to or greater than the width of cavity 102 so as to allow articles within the cavity to pass through the now open base without obstacle.

Figure 2B:
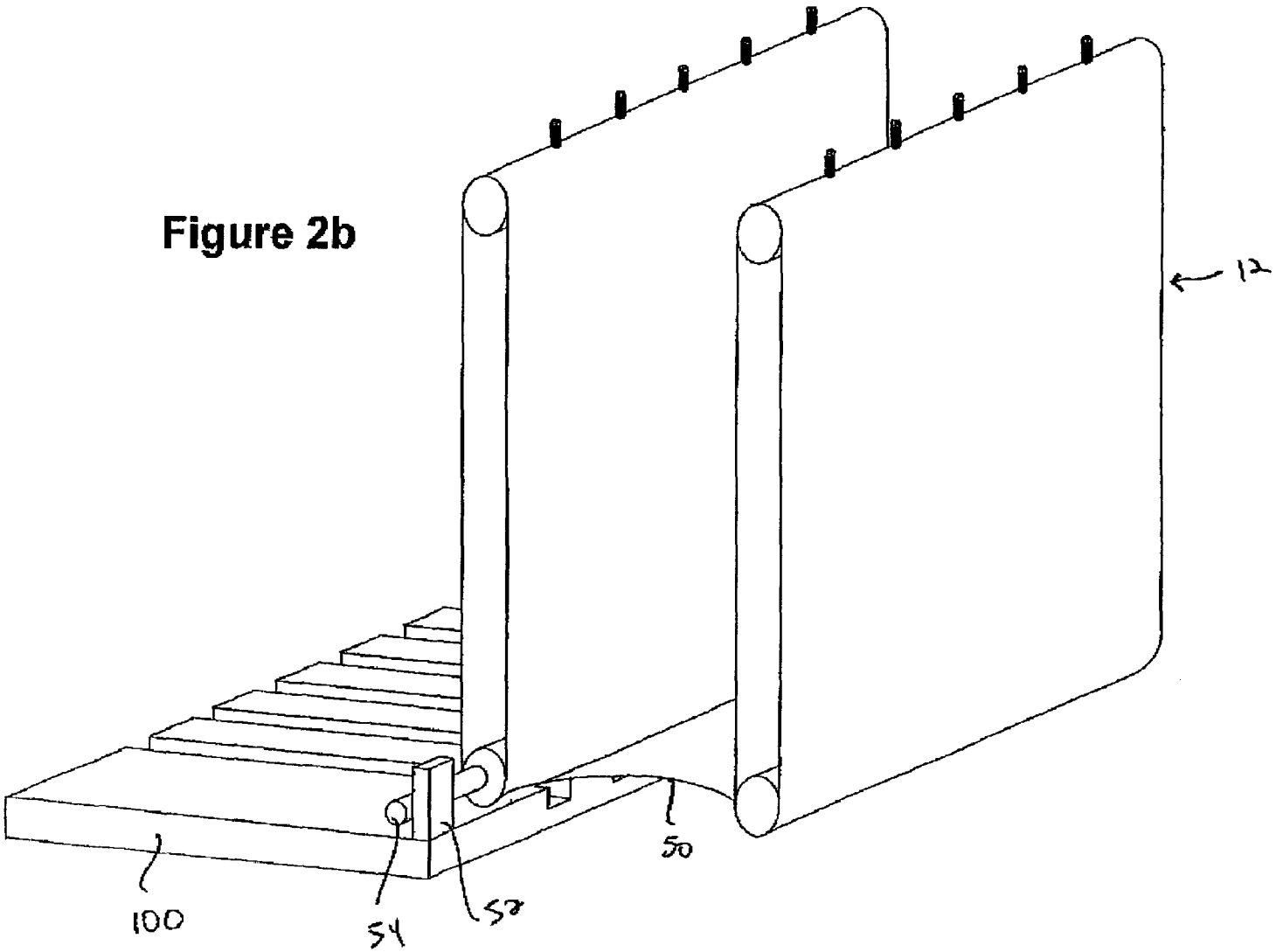
FIG. 2*b* depicts a second view of the pocket according to FIG. 2*a;*

FIG. 2*b* depicts the pocket 12 with base 100 removed and second sheet 50 descended. Prongs 52 abut protrusions 54. The descending motion of the second sheet will urge articles within the cavity through the now open pocket bottom. The combination of the first and second sheet comprise an H-belt.

Figure 3A:
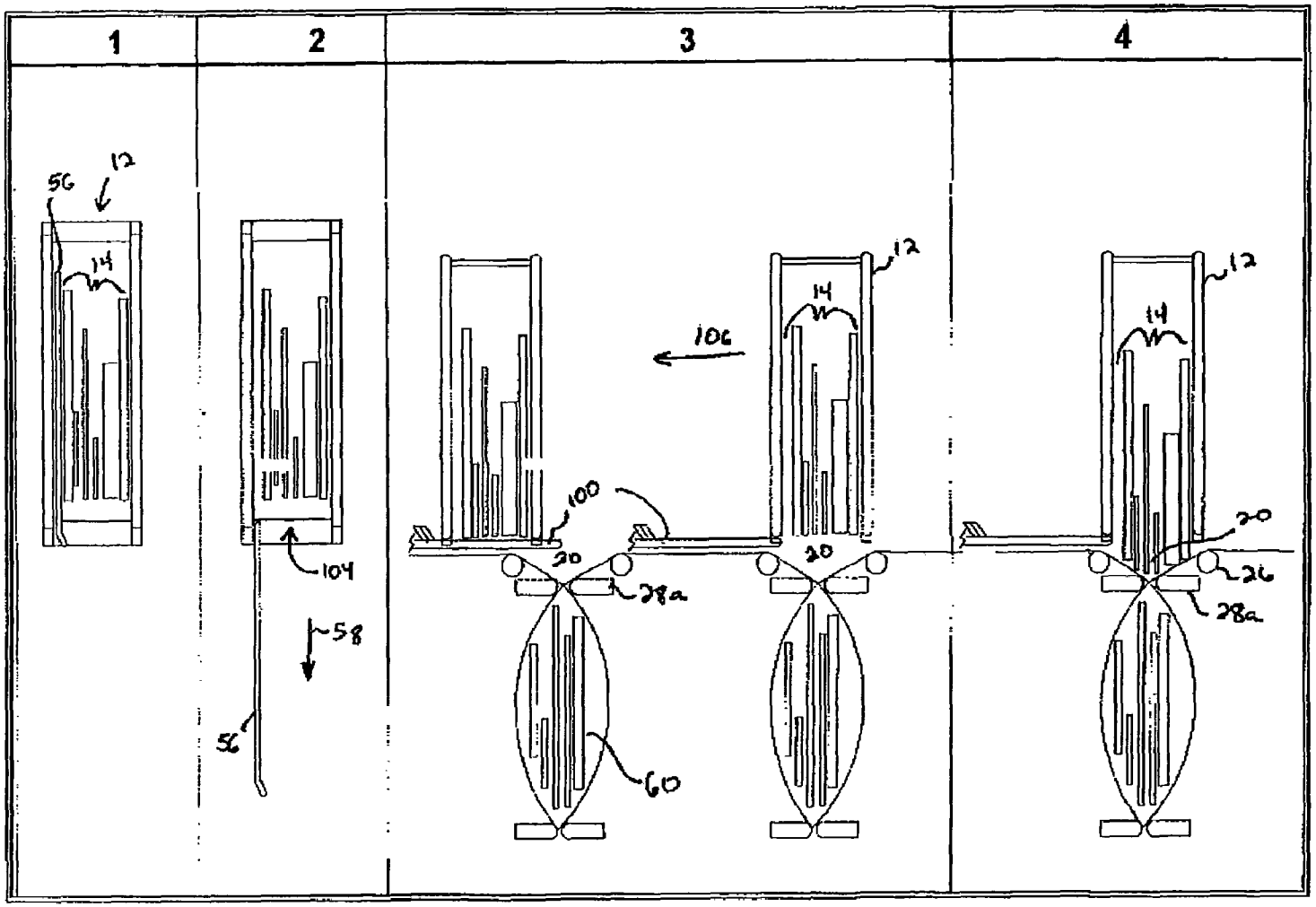
FIGS. 3*a* and 3*b* depict operation of the present method.
Figure 3B:
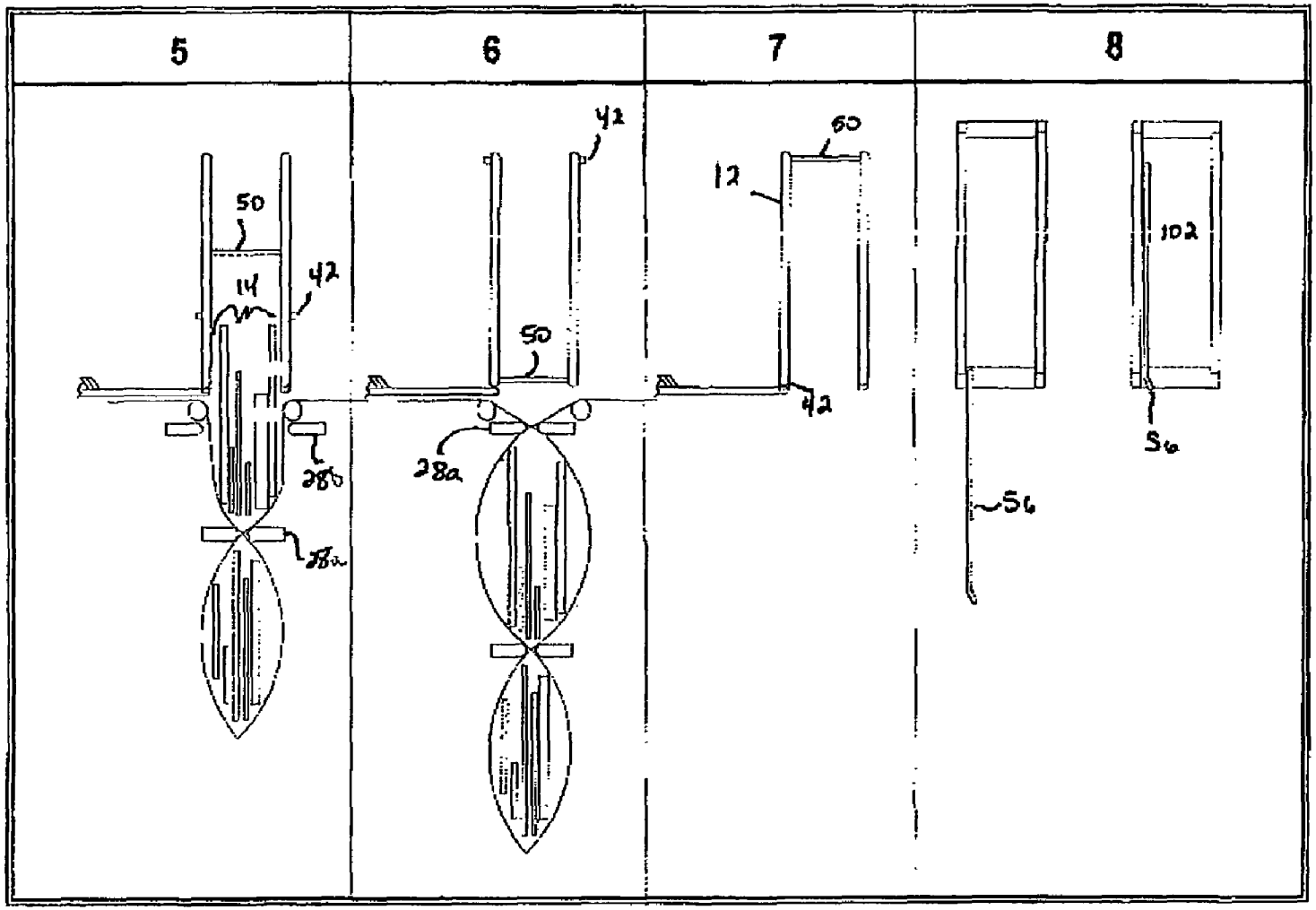
Figure 4:
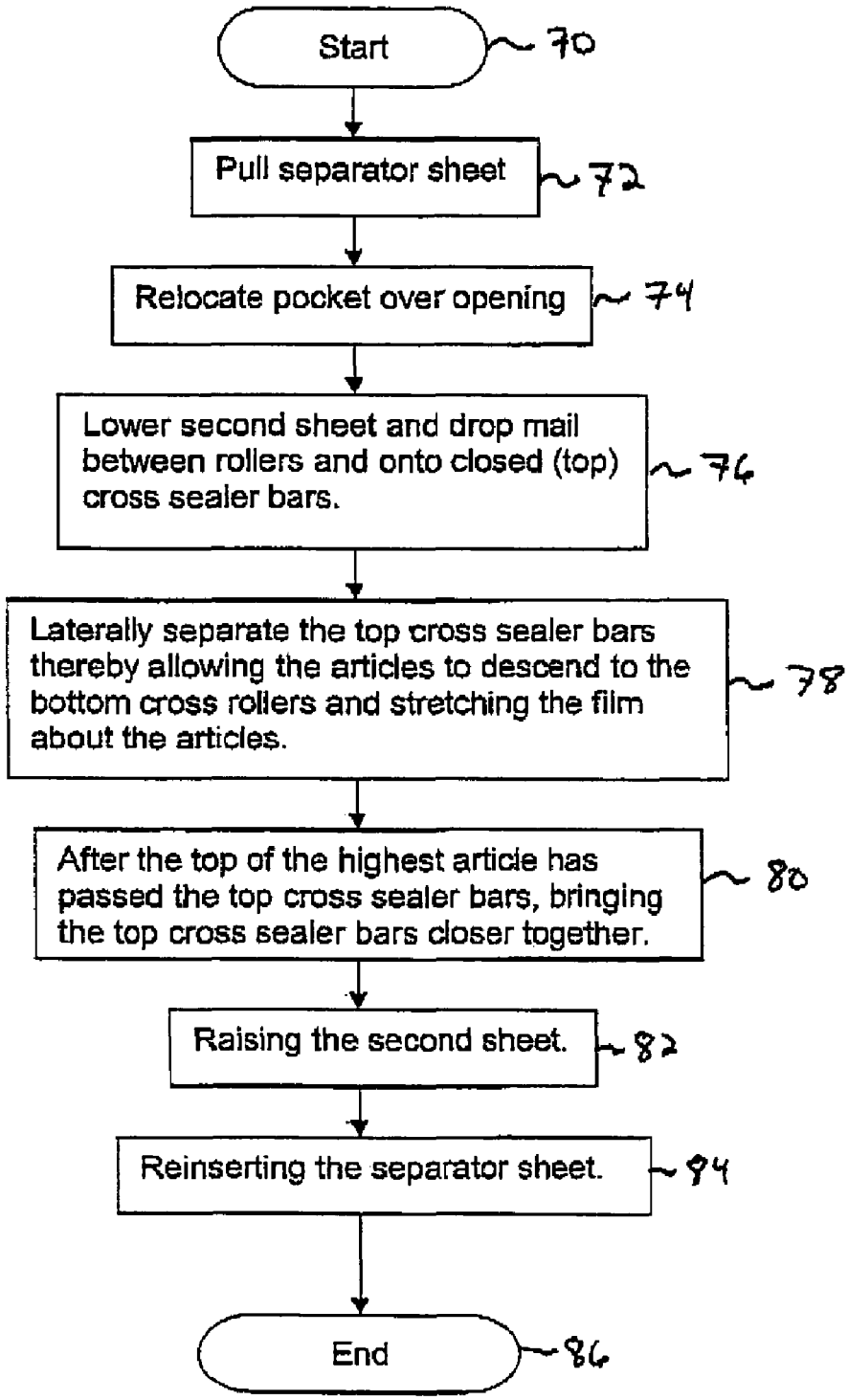
FIG. 4 depicts a flowchart of the present method.

The operation of the present invention will now be described with reference to FIGS. 3*a*, 3*b* and 4. FIGS. 3*a* and 3*b* are divided into four sections each (labeled 1-8). FIG. 4 depicts a flowchart of the present inventive method. Sections 1, 2 and 8 depict pocket 12 from above and the remaining figures depict the pocket from the side. The method starts (step 70). Stored in pocket 12 are articles 14 and separator sheet 56. As depicted in section 2 separator sheet 56 is removed (step 72) from an open side in the direction as indicated by arrow 58.

FIG. 3 depicts a side view of the pocket 12 with the separator sheet 56 now removed. A previously wrapped group of articles 60 is depicted below top cross sealer bars 28*a*. Moving from the left to right side of the figure, the pocket 12, with base 100 therebelow, is laterally displaced over the top of opening 20 (step 74). Once the pocket is arranged over opening 20 (left image), the base 100 is laterally displaced in the direction indicated by arrow 106 thereby exposing articles 14 to opening 20.

In section 4, the articles 14 accommodated within pocket 12 drop into opening 20 and rollers 26 and atop top cross sealer bars 28*a* (step 76).

In section 5, the cross section bars 28*a* descend in the direction of bottom cross bars 28*b*. This action pulls down the film with the articles creating the side walls which will seal in the articles with the film. Additionally, bottom cross section bars 28*b* now rise into position above top cross section bars 28*a* thereby getting ready for the next group of articles. The second sheet 50 is depicted partially descended and protrusions 42 partially elevated (step 78).

In section 6, with the tallest articles descending below the top cross sealer bars 28*a*, the top cross sealer bars 28*a* are brought together. The second sheet 50 is depicted fully descended and protrusions 42 fully elevated (step 80).

In section 7, with the pocket 12 now empty, the second sheet 50 is elevated back to a top position with the protrusions 42 descended into a bottom position (step 82).

In section 8, the separator sheet 56 is reinserted in cavity 102 (step 84). At this point, the now empty pocket may be reintroduced for receiving new mail and the method continues with the next pocket including articles therein. The method then ends (step 86).

The invention being thus described, it will be obvious that the same may be varied in many ways. Such variations are not to be regarded as a departure from the spirit and scope of the invention, and all such modifications would be obvious to one skilled in the art are intended to be included within the scope of the following claims.

I claim:

1. A method for handling and polywrapping at least one article, comprising the steps of:

inserting a separator sheet and said at least one article into a pocket, said pocket comprising sidewalls, an open front and back, and a closed bottom;

positioning said pocket over polywrapping means;

removing said separator sheet through one of said open front and back;

displacing said bottom so as to create an opening having a sufficient size so as to allow said at least one article to pass therethrough; and removing said articles through said opening.

2. The method according to claim 1, further comprising the step of polywrapping said articles.

3. The method according to claim 2, wherein said step of polywrapping further comprises the steps of:

crimping a polywrapper at one end, before said articles are urged through said opening, so as to provide a slot bottom; and crimping said polywrapper at a second end so as to provide a slot top thereby effectively containing said articles within said polywrapper between said bottom and top.

4. The method according to claim 3, wherein said slot top forms a slot bottom for a subsequent group of articles.

5. The method according to claim 1, wherein said bottom comprises a plurality of tracks and said sidewalls include a plurality of protrusions each arranged to interact with said tracks thereby facilitating lateral movement of said bottom while said sidewalls remain relatively substantially static and preventing articles from getting in between said side walls and said bottom.

6. The method according to claim 1, wherein said step of removing said articles further comprises the step of urging said articles through said opening with an H belt.

7. The method according to claim 6 further comprising the step of resetting said H belt after said articles are urged through said opening.

8. The method according to claim 1, wherein said articles comprises at least one of mail, books, and magazines.

9. A system for handling and polywrapping articles, comprising of:

a pocket comprising a separator sheet sidewalls, an open front and back, and a closed bottom;

means for positioning said pocket over polywrapping means;

means for displacing said bottom so as to create an opening having a sufficient size so as to allow said at least one article to pass therethrough; and means for removing said articles through said opening.

10. The system according to claim 9, further comprising means for polywrapping said articles and means for removing said separator sheet.

11. The system according to claim 10, wherein said means for polywrapping further comprises:

a first means for crimping a polywrapper at one end, before said articles are urged through said opening, so as to provide a slot bottom; and a second means for crimping said polywrapper at a second end so as to provide a slot top thereby effectively containing said articles within said polywrapper between said bottom and top.

12. The system according to claim 11, wherein said slot top forms a slot bottom for a subsequent group of articles.

13. The system according to claim 9, wherein said bottom comprises a plurality of tracks and said side walls comprise a plurality of protrusions each arranged to interact with said tacks thereby facilitating lateral movement of said bottom while said sidewalls remain relatively substantially static and preventing articles from getting in between said sidewalls and bottom.

14. The system according to claim 9, wherein said means for removing said articles further comprises means for urging said articles through said opening with an H belt.

15. The system according to claim 14, further comprising means for resetting said H belt after said articles are urged through said opening.

16. The system according to claim 9, further comprising means for reinserting said separator sheet.

17. The system according to claim 9, wherein said articles comprises at east one of mail, books, and magazines.

* * * * *